US005249632A

United States Patent [19]

Sparling et al.

[11] Patent Number: 5,249,632

[45] Date of Patent: Oct. 5, 1993

[54] REMOTE NOZZLE UNIT

[75] Inventors: Fred Sparling, St. John's; Wilfred Maloney, Gander, both of Canada

[73] Assignee: Helitactics Ltd., St. John's, Canada

[21] Appl. No.: 589,202

[22] Filed: Sep. 26, 1990

[51] Int. Cl.[5] ..... A62C 31/28

[52] U.S. Cl. ..... 169/52; 169/54; 239/587.4; 239/273; 239/275

[58] Field of Search ..... 169/52, 54, 70; 239/587, 273, 275, 279, 280; 285/261

[56] References Cited

U.S. PATENT DOCUMENTS

| | | | |
|---|---|---|---|
| 557,799 | 4/1896 | Gorter | 239/587.3 |
| 589,244 | 8/1897 | Cantore | 169/52 X |
| 978,107 | 12/1910 | Berry | 239/587.3 |
| 1,674,693 | 6/1928 | MacGregor | 239/280 |
| 2,086,724 | 7/1937 | McAulay | 239/273 |
| 3,206,234 | 9/1965 | Bentley . | |
| 3,454,288 | 7/1969 | Mancusi | 285/261 X |
| 3,583,637 | 6/1971 | Miscovich | 169/54 X |
| 3,612,408 | 10/1971 | Holleman | 239/587 |

FOREIGN PATENT DOCUMENTS

| | | | |
|---|---|---|---|
| 0041060 | 5/1981 | European Pat. Off. . | |
| 0036287 | 9/1981 | European Pat. Off. . | |
| 1504797 | 10/1967 | France . | |
| 2517758 | 12/1981 | France . | |
| 2646782 | 11/1990 | France | 169/52 |
| 1066616 | 1/1984 | U.S.S.R. | 169/70 |
| 1443884 | 12/1988 | U.S.S.R. | 169/52 |
| 1461480 | 2/1989 | U.S.S.R. | 169/52 |
| 485161 | 5/1938 | United Kingdom . | |
| 628730 | 9/1949 | United Kingdom | 239/587 |
| 1512036 | 5/1978 | United Kingdom | 169/52 |
| 2105615 | 3/1983 | United Kingdom . | |

*Primary Examiner*—David M. Mitchell
*Assistant Examiner*—Gary C. Hoge
*Attorney, Agent, or Firm*—Wenderoth Lind & Ponack

[57] ABSTRACT

There is described a portable water monitor for fire fighting, irrigating or other watering purposes. The water invention is of compact, stable, light-weight configuration. The device has a base unit which may be filled with water to increase the weight of the unit when deployed in the field. Compact plumbing is provided which permits the monitor nozzle to be rotated 360° in the horizontal direction about a vertical axis swivel coupling and to be elevated and depressed in a ball and socket coupling. The ball and socket coupling additionally provides that the monitor nozzle may be offset relative to the swivel action coupling on the ball and socket coupling. This offset, which is actually the ability to point the nozzle away from the unit's vertical axis, creates a rotational force for the nozzle by harnessing a portion of the reaction force which acts through the center of the nozzle. The unit can be manually or remotely controlled.

13 Claims, 7 Drawing Sheets

REMOTE NOZZLE UNIT

BACKGROUND OF THE INVENTION

The present invention relates to portable water monitors.

The portable monitor of the present invention is useful in the fighting of fires in forested or rural environments, however this is not its exclusive use. The device according to the invention can be used in certain urban fire fighting situations and indeed, in many situations not related to fighting fires but where it is desired for environmental purposes (cleaning, cooling, irrigating, etc.) to control the dispersal of pressurized water.

The three desirable characteristics of a portable water monitor are stability, low weight, and articulation.

Clearly the greater the water flow, the more effective the monitor. There does exist however, a direct relationship between water flow and the reactive force which acts back through the nozzle. As flow increases so does reactive force. The problem that this reactive force can cause for a portable water monitor is that the more the nozzle is pointed away from the vertical axis, the more is the increase in the horizontal force vector. This horizontal force component could result in not only upsetting the monitor by tipping but also in moving the monitor along the ground in a sliding action. Previous proposals to overcome the stability problem with portable monitors has been to increase the total weight of the unit, to provide for the attachment of the unit to an external anchor point, to increase the base area of the unit and to lower, through the plumbing arrangement, the thrust point through which the nozzle sprays. The lowering of the thrust point attempts to ensure that the reactive force vector acts through the unit's base. There exists therefor a contradiction in that, in order to be suitable for portability, the monitor and its plumbing should be of light weight, whereas in order to provide a stable base unit, the base should have a heavy weight.

The factor of nozzle articulation, also bears on weight and stability. To be effective a water monitor nozzle must be capable of movement in both the horizontal and elevation directions. Since a metal tube carrying pressurized water cannot be bent readily, it is necessary, with conventional monitors, to provide a sealed axis for each desired articulation. This is accomplished with a multitude of curved tubing and seal arrangements. A certain compactness has been achieved in some designs by clever plumbing arrangements but these have, in the main, paid the price of weight and complexity and high production cost.

SUMMARY OF THE INVENTION

The present invention seeks to provide a compact, stable, light weight unit, which can be deployed in a number of situations.

Accordingly the present invention provides a portable fire fighting monitor comprising a base member; fluid input conduit means for the base member; a vertical axis swivel action coupling having a lower part and an upper part, said coupling being operatively connected at its lower part to said fluid input conduit means and being operatively connected at its upper part to a fluid output conduit means; a ball and socket coupling operatively connected to said fluid output conduit means; a monitor nozzle operatively connected to an outer end of the ball and socket coupling; means to elevate and depress the nozzle relative to the base member on the ball and socket coupling; means to rotate the nozzle and the ball and socket coupling relative to the base member, on the swivel action coupling about a vertical axis of the coupling and means to offset position, or skew, the nozzle relative to the swivel action coupling, on the ball and socket coupling.

In a preferred form of the device according to the invention, the swivel action coupling has a 360° turning capability to enable the nozzle and the ball and socket coupling to be completely rotated about the vertical axis of the coupling by the means to rotate the nozzle and the ball and socket coupling.

Conveniently the base member is an essentially hollow structure of generally circular configuration having upper and lower surfaces joined by a peripheral wall, and means to permit filling and emptying of at least a major part of the hollow structure with water to impart stability to the base member.

The means to rotate the nozzle and the ball and socket coupling relative to the base member preferably includes a plate like member mounted for rotation about the vertical axis, above and generally parallel to the upper surface, and operatively connected on the one hand to the swivel action coupling and adapted, on the other hand, to run on circumferential track means adjacent an outer edge of the upper surface.

In one embodiment of the present invention the device is manually controlled and it further includes a nozzle guide means mounted on the flat plate like member and embracing the nozzle, and a manually operable control arm means attached to the nozzle and operable to rotate the nozzle, the ball and socket coupling, the nozzle guide means and the plate like member, about the coupling vertical axis, on the track. The manually operable control arm may be used as the means to elevate and depress the nozzle which may further include guideways in the nozzle guide means and guide elements on the nozzle engaging in the guideways to permit elevation and depression of the nozzle relative to the nozzle guide means. Suitably a means to offset position the nozzle may comprise a vertically oriented pivotal connection between the plate like member and the nozzle guide means which vertically oriented pivotal connection is radially spaced from the coupling vertical axis, locking means may be provided to secure the nozzle guide means to the plate like member.

In a different embodiment of the present invention the device may be power operated. In such an aspect the means to rotate the nozzle and the ball and socket coupling relative to the base member may suitably further include a motor mounted on the plate like member, which motor is drivingly connected to a friction drive means which engages the track adjacent the outer edge of the upper surface.

The means to elevate and depress the nozzle may comprise a pair of substantially telescopically extending—and—retracting drive elements, spaced one on either side of the longitudinal axis of the nozzle, each drive element being connected at one end to the plate like member and, at its other end pivotally to the nozzle, whereby uniform extension of the drive elements causes the nozzle to move on the ball and socket coupling to depress the nozzle and uniform retraction of the drive elements causes the nozzle to move on the ball and socket coupling to elevate the nozzle.

According to a preferred feature of the invention the means to offset position the nozzle comprises a pair of substantially telescopically extending—and—retracting drive elements, spaced one on either side of the longitudinal axis of the nozzle, each drive element being connected at one end to the plate like member and, at its other end pivotally to the nozzle, whereby differential extension and retraction of equal magnitude of the drive elements causes offset positioning of the nozzle relative to the swivel action coupling by skewing the ball in the socket of the ball and socket coupling.

Conveniently the drive elements may be electrical linear actuators.

In one preferred form of the invention the means to elevate, depress and offset position the nozzle may be remotely controlled and further remotely controlled means may be provided to govern a flow control actuator and a spray pattern control actuator for the nozzle. Conveniently the remote control may be a radio control or in addition, a hard wire control may be provided, capable of overriding the radio control and taking over the operation of the device.

The present invention also provides a base member for a portable fire fighting monitor comprising an essentially hollow structure of generally circular configuration having a top and a bottom joined by a peripheral wall, and means to permit filling and emptying of at least a major part of said hollow structure with fluid to impart stability to said base member; and pressure fluid delivering means mounted in said base. Preferably the base member is of generally torroidal configuration having a central axially throughway to accommodate the pressure fluid delivery means.

According to another aspect of the invention there is provided a ball and socket coupling for use in a pressure fluid transmission system comprising a hollow part-spherical coupling first member, and an embracing coupling second member, adopted; to receive said first member in fluid tight relation, and permitting relative motion with two degrees of freedom between the first and second members.

The invention further provides in a coupling for use in a pressure fluid transmission system, which coupling is of the type in which a ball shaped swivel coupling part is received in fluid tight relation in a socket part, the improvement wherein the spherical outer surface of the ball shaped part is formed of a smaller diameter near its discharge end than at its inner end.

BRIEF DESCRIPTION OF THE DRAWINGS

The following is a description by way of example of certain embodiments of the present invention reference being had to the accompanying drawings in which.

DESCRIPTION OF PREFERRED EMBODIMENTS

Figure 1:
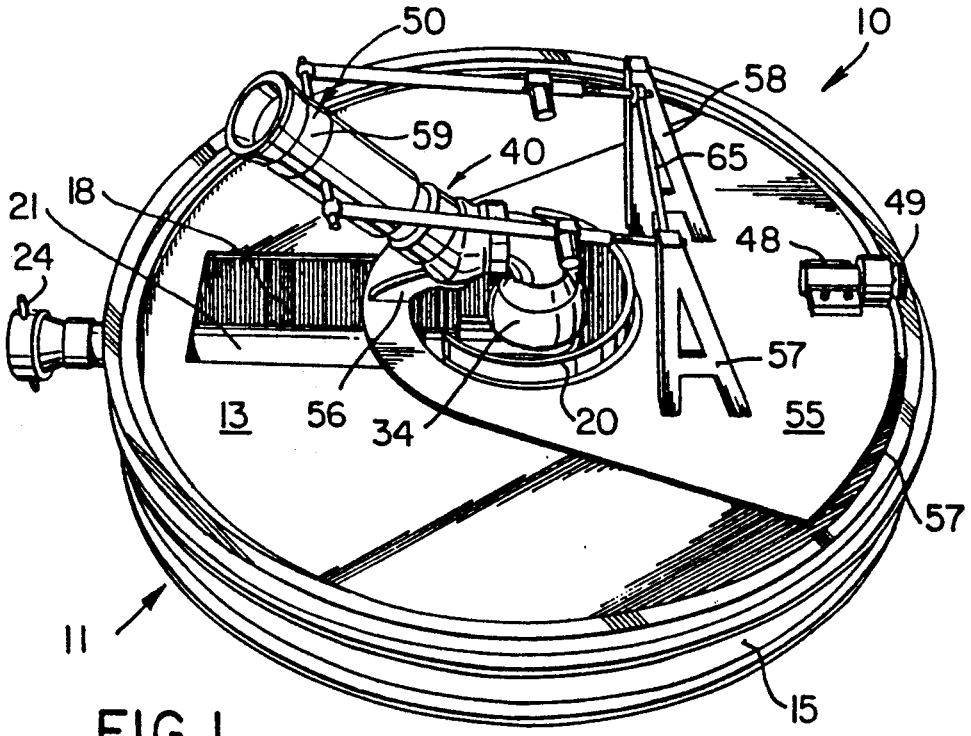
FIG. 1 is a perspective view of a power operated monitor.

Turning now to FIGS. 1 to 4 of the drawings.

The monitor 10 comprises a base member 11 which is an essentially hollow structure (see FIG. 4) of generally circular configuration having upper and lower surfaces, or face plates 12, 13, joined by a peripheral wall 15, which may be hoop-like in configuration. The lower surface 12 is of as large a diameter as is convenient, in order to provide a wide ground engaging surface. The base member has a major portion 17 formed as a hollow drum-like structure which can be filled with the water to substantially increase the weight of the unit and to provide stability for the device in the field. Any suitable valve, part, or aperture, may be provided for filling and emptying the section 17. The drum-like section 17 is separated from the rest of the interior of the base by a pair of sidewalls 18 and 19 terminating in a cylindrical centre post 20. A fluid (usually water) input conduit 21 is positioned between the sidewalls 18 and 19 and extends outside the base member 11 where it is provided with a suitable hose coupling 24 of known configuration.

The conduit 21 is operatively connected at its inner end to the lower part, shown here as a fixed lower elbow 31, of a vertical axis swivel action coupling 30. The coupling has an upper part, seen here as an upper rotating elbow 32. The fixed lower part and the movable upper part are connected together by a sealed ball bearing connection 34. The vertical axis swivel action coupling 30 is a standard item such as is made by Dover Corporation of Mason, Ohio, U.S.A. The upper elbow 32 is capable of total 360° rotation in the connection 34. Welded to the upper elbow 32 is a fluid output conduit 35 which houses a ball and socket connection 40 comprising a ball 41 sealingly rotatable within a socket 42. Again the ball and socket coupling is a standard item and can be obtained from Hydra-Squid Manufacturing, Inc. of Ocala, Fla. The socket 42 is screw threaded onto the output conduit 35 and is sealed therewith. Operatively connected to the outer end 45 of the ball and socket coupling is a monitor nozzle 50. The monitor nozzle may be any suitable standard nozzle and as shown in this example is a nozzle known generally as an automatic nozzle. The model illustrated here is patterned on the model HTFT-V manufactured by Task Force Tip Inc. of Valparaiso, Ind., U.S.A.

Figure 2:
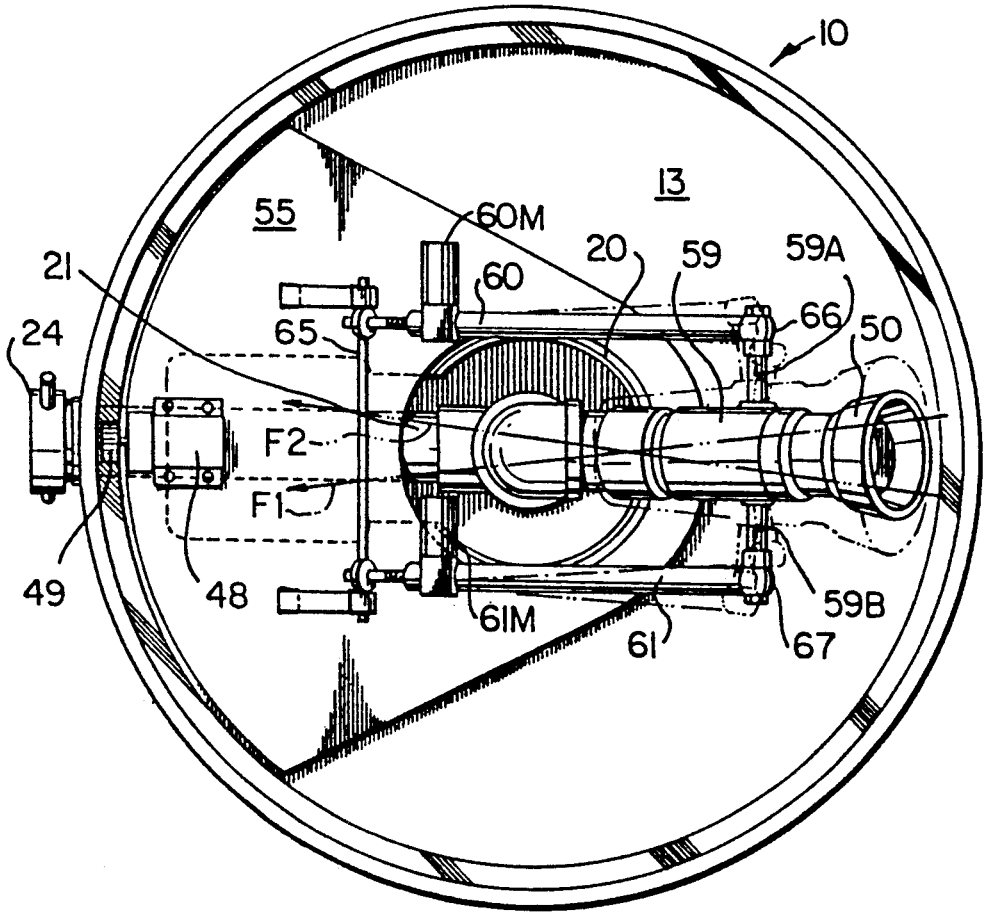
FIG. 2 is a plan view of the device shown in FIG. 1.
Figure 3:
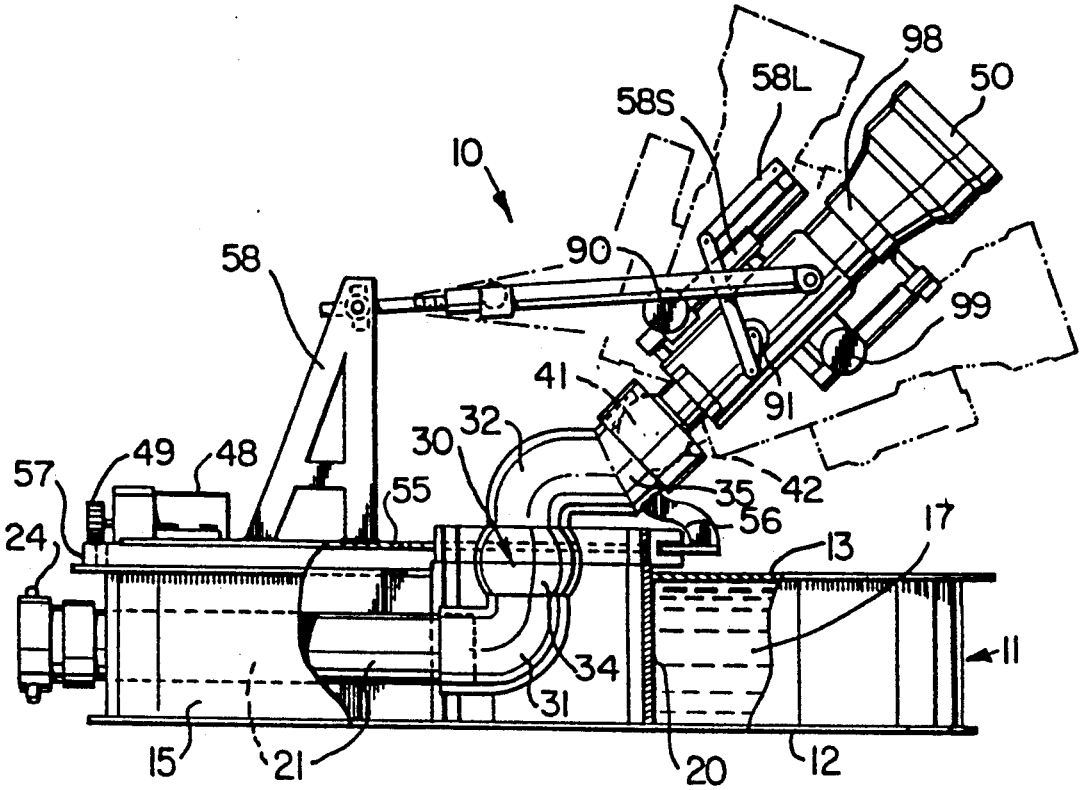
FIG. 3 is a side elevation, partly broken away to show the hydraulic and mechanical connections.
Figure 4:
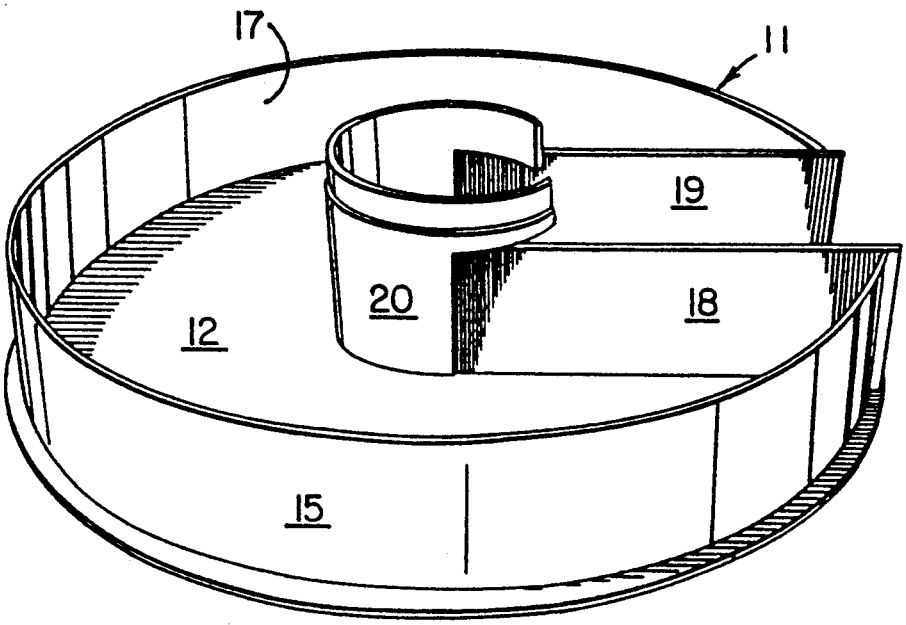
FIG. 4 is a detail, in perspective, of lower portion of the base unit of FIGS. 1 to 3.

In the automatic control embodiment as illustrated in FIGS. 1, 2 and 3, control of the positioning of the nozzle 50 is by means of an electric motor 48 which may be remotely controlled by a radio controller, or as is known in the art, by hard wiring from a remote switch.

Mounted for rotation on the cylindrical centre post 20 is a flat plate member 55, here shown of sector-like configuration. The plate member 55 is vertically spaced from the upper surface 13 of the base member 11 for rotation generally parallel and relative thereto. At the front end the sector-like plate member 55 is provided a bracket 56 which connects to the swivel action coupling at the output conduit 35. A circumferential track 57 encircles the upper periphery of the upper plate, or surface, 13 and an electric motor 48 (such as made by Pittman Motor, Harleysville, Pa., U.S.A.) drives a friction wheel 49 around the track 57 to drive the sector 55 completely through 360° to rotate the nozzle 50 about the vertical axis of the swivel action coupling 30. A suitable electrical battery, not shown, may be mounted on the sector 55 to provide power for the motor 48.

Mounted on and upstanding from, the upper surface of the sector-like plate member 55 are a pair of brackets 57, 58. The nozzle 50 is provided with a suitable collar 59 with outwardly extending trunnions 59A and 59B. Between the brackets 57 and 58 and the trunnions 59A and 59B, at each side of the nozzle 50, is provided a telescopically extending—and—retracting drive element, here shown in the form of an electrical linear actuator 60, 61 of the ball drive variety. These again are standard items such as made by Motion Systems Corporation of Shrewsbury, N.J., U.S.A. The ball drive actuators 60 and 61 are connected at their rear ends to the cross arm 65 of the brackets 57, 58 and swivelably at their front ends at 66, 67 to the trunnions 59A and 59B of the collar 59. When the electric motors 60M and 61M are driven synchronously so as to uniformly, telescopically extend the ball drive actuators 60, 61, the nozzle 50 is depressed (see FIG. 3 lower dotted line position), the ball member 41 of the ball and socket coupling rotating within its socket 42. Conversely when the motor 60M and 61M are reversed and the ball drive actuators are uniformly retracted, the nozzle 50 is again rotated on the ball 41 in its socket 42 to elevate the nozzle (see upper dotted position in FIG. 3). It will be noted from FIG. 3 that the reaction force from the operation of the nozzle 50 will, in most positions be through the base, and in the more elevated positions, through the wide bottom 12 of the base. This provides great stability to the monitor in the field, particularly when the chamber 17 is filled with water as is shown in FIG. 3.

Conveniently, the underside of the bottom plate 12 of the base may be roughened to increase the resistance of the base to sliding motion over the ground by the monitor, when in operation on a smooth surface due to the reactive forces of the water. This eliminates the necessity to anchor the base to an external point.

By differentially operating the motor 60M and 61M so as to extend the ball drive actuator 60, and retract the actuator by equal amounts, a skewing, or offsetting, action of the ball 41 within its socket 40 takes place and the nozzle 50 is offset relative to the swivel action coupling 30. Operation of the motors 60m and 61m in the opposite direction offsets the nozzle 50. If extension and retraction of actuators 60, 61 is not equal, elevation of the nozzle 50 will be affected. It will be immediately seen that because of the skewing, the reaction force from the nozzle 50, when in operation, is no longer in a straight line through the axis of the swivel section 32 but rather produces a component of force F1 or F2, through the centre of the ball, depending upon the direction of skew (see FIG. 2). This has the effect of rotating the nozzle 50 about the vertical axis of the swivel action coupling 30 so that the nozzle is rotated by the simple reaction force of the water which it is delivering. This is an ideal situation where it is desired to wet down an entire area in advance of a fire, or irrigate an area, because the nozzle 50 can rotate without the requirement of any battery drive or the like. Indeed where the motor 48 which frictionally drives on the track by means of the friction wheel 49 is electrically wired in a suitable fashion, the motor 48 can act as a generator and trickle charge the battery as a result of the rotation of the nozzle 50 with the sector 55.

As seen in FIG. 3, a similar linear actuator 58S is mounted on the sleeve 59 of the nozzle to operate linkage 58L to actuate the lever 91 to control the volume flow of the nozzle. In a shelf standard version of the automatic nozzle a manually operated lever, similar in its function to the lever 91 is provided. Actuator 58 and linkage 58L provides for remote control. To automatically adjust the spray pattern control, which in the standard automatic nozzle is controlled by a ring 98, a further ball drive actuator, or the like, device 99, is provided to control the spray pattern. Both ball actuator 90 and 99 may be remotely controlled similarly to the motor 60, 61M and 48.

Figure 5:
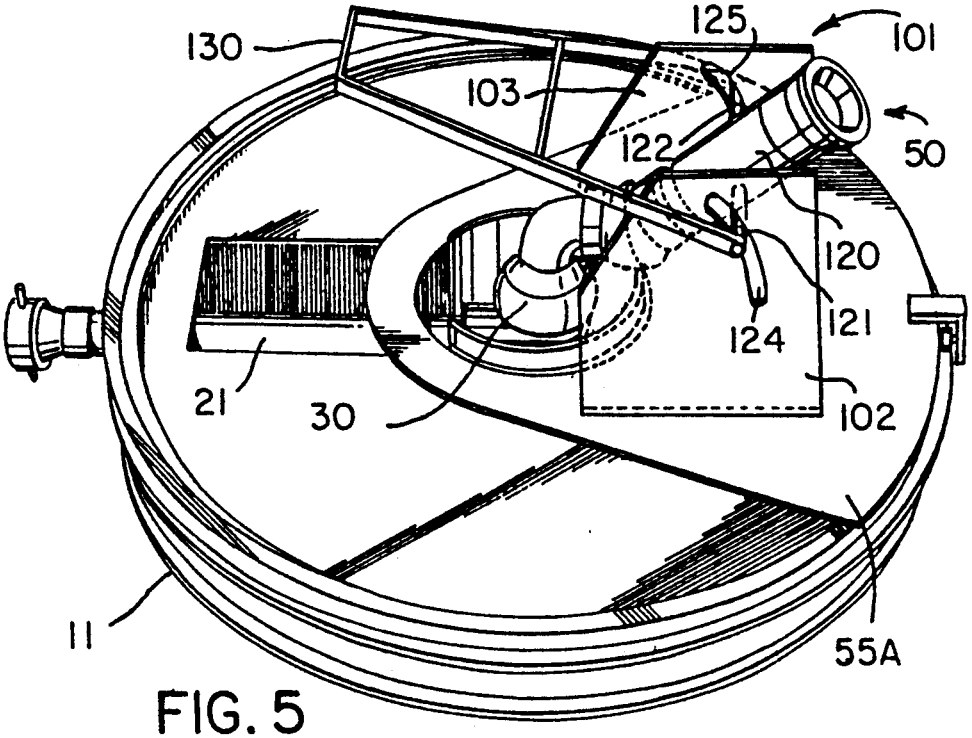
FIG. 5 is a view similar to FIG. 1 of an alternative embodiment.
Figure 6:
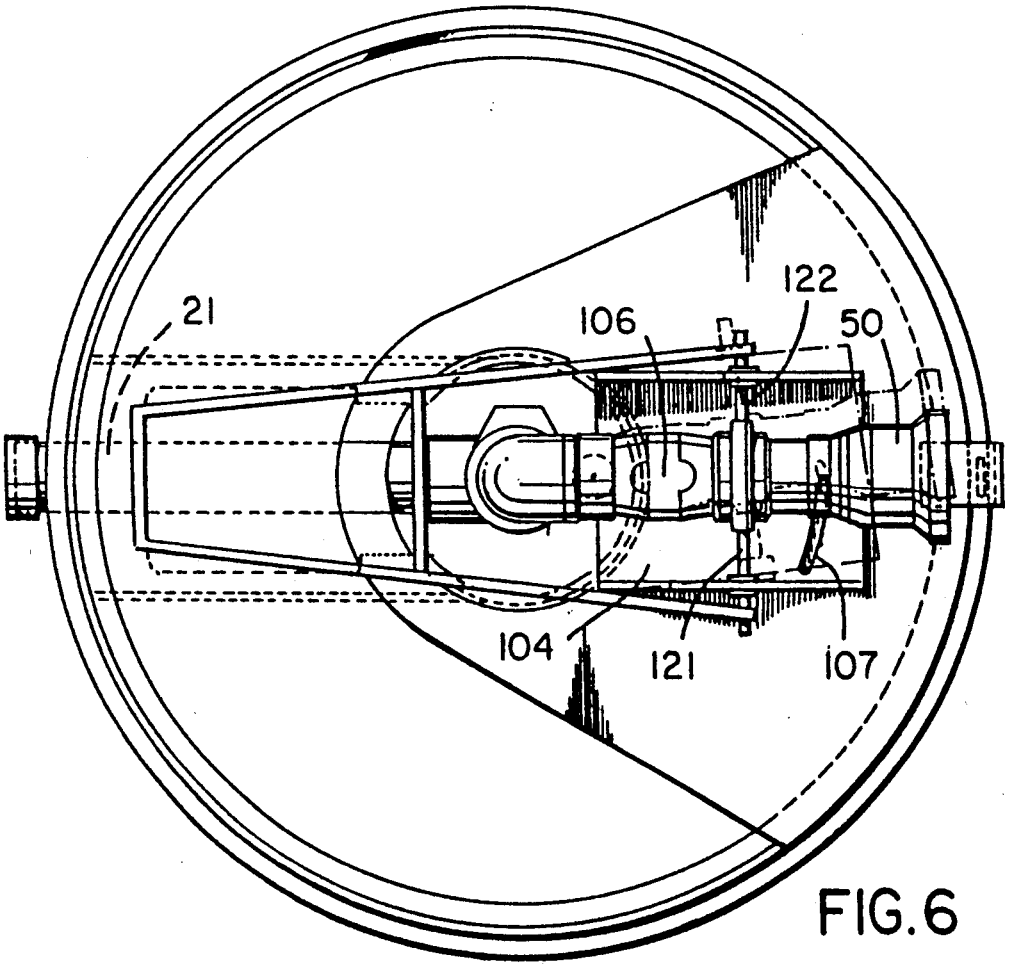
FIG. 6 is a plan view of the embodiment of FIG. 5.
Figure 7:
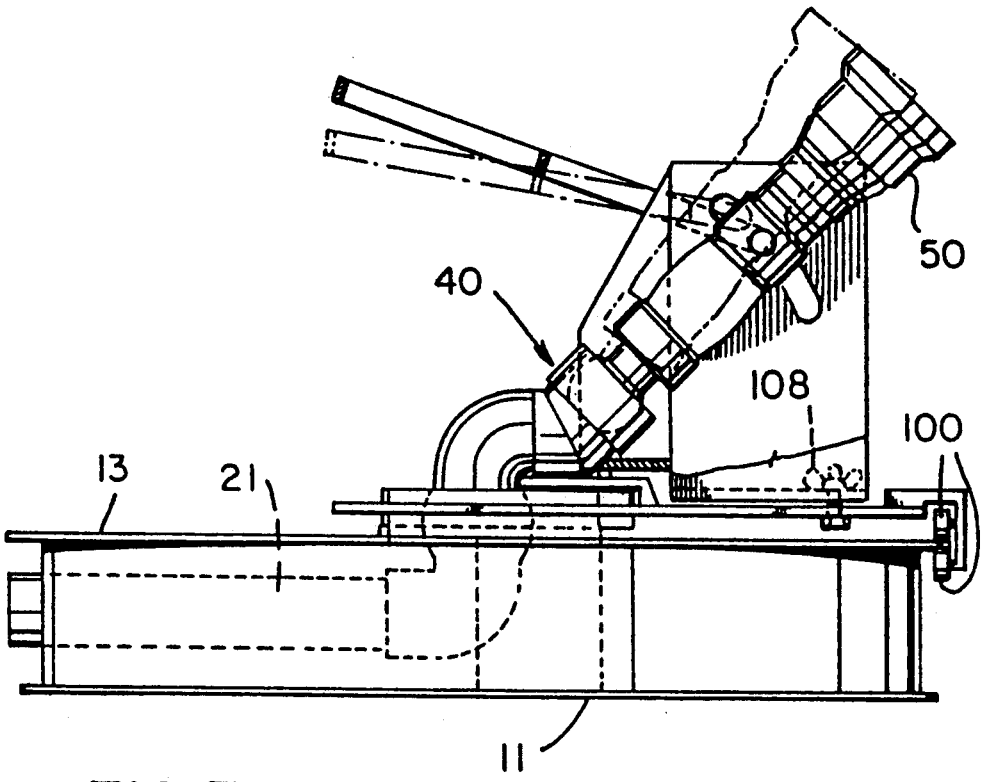
FIG. 7 is a side view of the embodiment of FIGS. 5 and 6.

Turning now to FIGS. 5, 6 and 7, there is shown a manually operated version of the device as seen in FIGS. 1 to 4. The base 11, plumbing, including conduit 21, swivel action coupling 30, ball and socket connection 40, and monitor nozzle 50 are essentially the same as in the previously described version. It will be noted however that the plate member 55A, again sector-like, has been reversed in its configuration and that the friction drive 49 and motor 48 have been replaced by a pair of rollers 100 which engage the outer periphery of the upper surface 13.

Mounted on the sector-like plate 55A is a nozzle guide member 101 which embraces the nozzle 50. The nozzle guide 101 has two upstanding guide walls 102, 103 and a floor plate 104. The guide 101 is pivotally mounted on the plate 55A by vertical pivot 106, radially spaced from the vertical axis of the coupling 30 so that the guide 101 may pivot about 106. A curved slot 107 (see FIG. 6) accommodates a wing nut 108, which when loosened, permits the nozzle guide 101 and the nozzle 50 with it to be rotated about vertical pivot 106 so that the ball 41 may be skewed in its socket 42. Tightening of the wing nut 108 secures the offset nozzle in place. Obviously the length and position of slot 107 will be selected to provide the desired sense and amplitude of offset.

As with the embodiment of FIG. 1, offsetting of the nozzle permits the reaction force of the water to rotate the nozzle about the vertical axis of the swivel action coupling 30 without the necessity to provide any other driving force. A sleeve 120 is provided on the nozzle 50 and this sleeve has two outwardly extending trunnions 121, 122 which extend through suitable guide slots 124, 125 in the guide walls 102, 103 respectively. A control arm 130 is fixed to the outer ends of the trunnions 121, 122 and can manually control the position of the nozzle in vertical and horizontal sense. Simple circular rotation of the control arm 130 causes the nozzle, and with it the ball and socket connection 40 to be rotated about the vertical axis of the swivel action coupling 30 through a full 360° range at the will of the operator.

Elevation and depression of the nozzle 50 which may suitably be 20° above and below a 45° natural setting to the base (as in the preceding embodiment) is accomplished by simply pushing and pulling on the control arm 130 so that the nozzle is elevated and depressed about the ball and socket joint 40. The guide elements, or trunnions 121, 122 moving in their guide ways 124, 125. Control of pressure and pattern of water stream is accomplished manually by the controls provided in the shelf nozzle.

Figure 8:
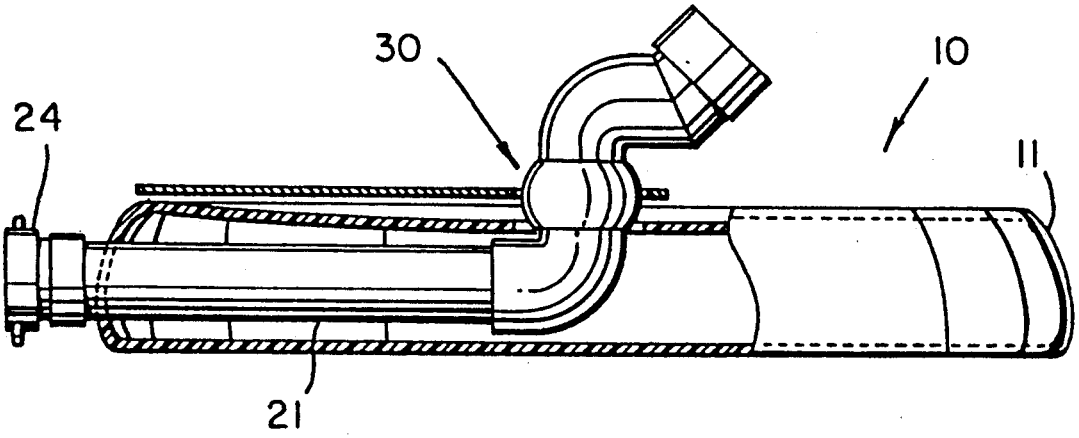
FIG. 8 is a simplified side view, partly in section of an alternative base configuration.

FIG. 8 shows an alternative construction of the base 10. Here the base member 11 is made from a plastics material, for example a high density polyethylene, rotationally, or vacuum, molded in one piece, or two. The bottom surface conveniently is generally flat (although it may be roughened) and the top surface is slightly concave. The interior of the base once again is hollow and capable of being filled with water. A suitable track, not shown, is provided around the periphery of the upper surface but the plumbing and controls would otherwise be the same as in the devices described with reference to FIGS. 1 through 4, or 5 through 7.

Figure 9:
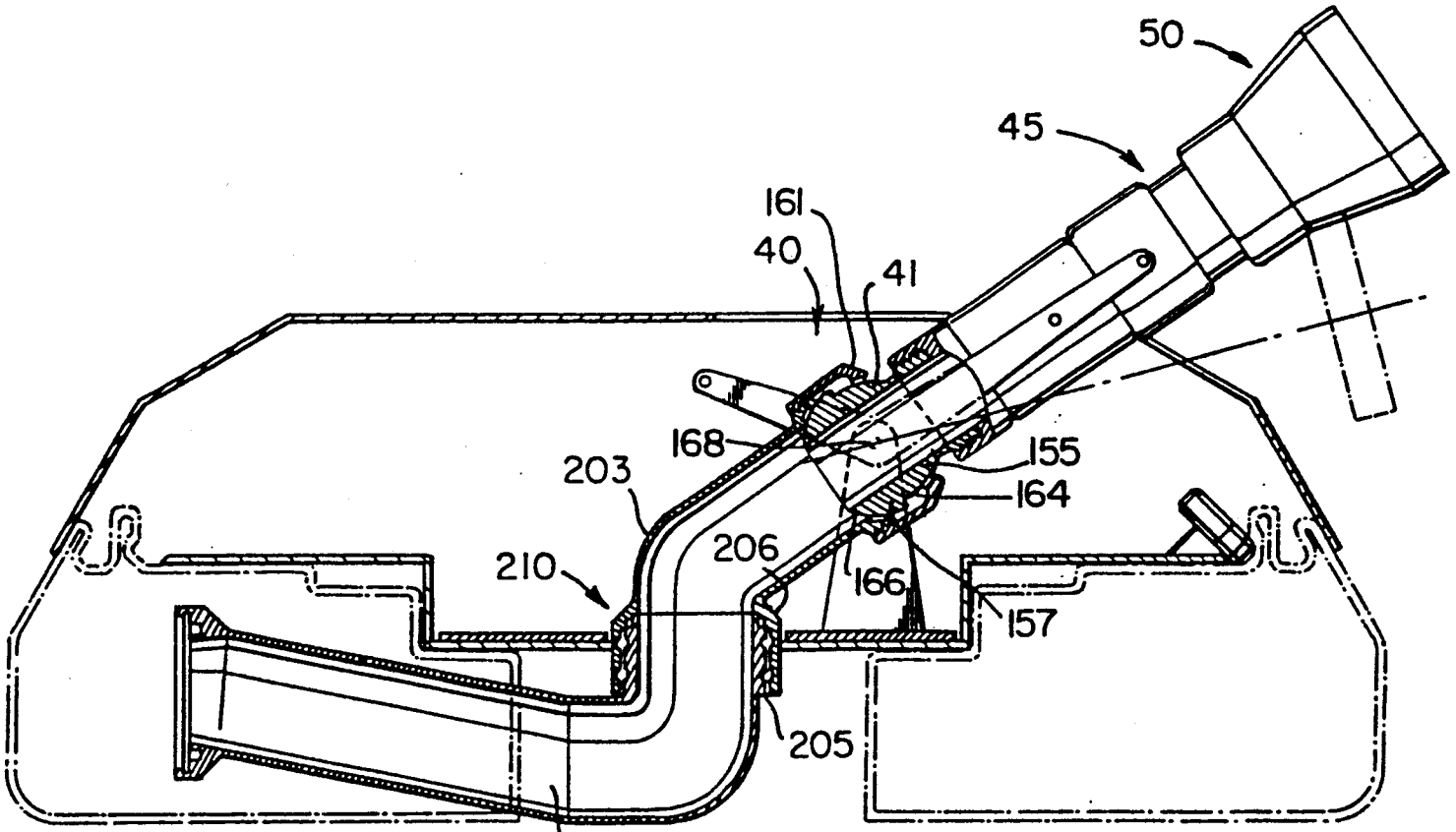
FIG. 9 is a sectional view of another embodiment, having a different ball and socket joint to that shown in FIGS. 1 through 8.

Turning now to FIG. 9 there is shown a further embodiment having a modified form of ball and socket coupling.

The ball and socket 40 is of the general type already described but in order to reduce the size and weight of the coupling and to enable the nozzle 50 to be attached closer to the ball, the ball 41 itself has been made so that it has a spherical surface 155 of smaller diameter near its discharge end than the diameter 157 of the spherical surface of its other part, near the inner end of the ball and socket. The socket 42 is dimensioned at 161 to accommodate the differences in the diameters of the surfaces of the ball parts, and to provide for ease of operation and maintenance of secure fluid tight relationship of the ball 41 within the socket 42. The smaller diameter surface 155 extends over a similar arc as the larger diameter surface 157. Indeed each surface 164, 166 is preferably arranged to extend over 50° to 60° arcs subtended at the ball center 168.

Figure 10:
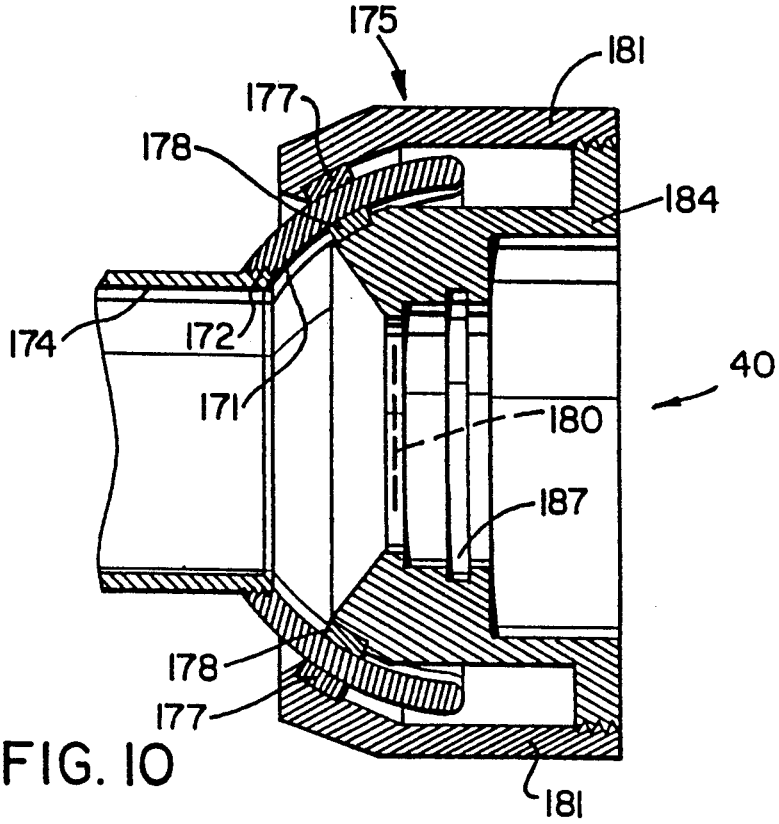
FIG. 10 is a sectional view showing a further type of ball and socket joint.

Turning now to FIG. 10, another form of ball and socket coupling 40 is shown. Here, the ball is formed from a hollow part-spherical first member 171 which is screw threaded or otherwise attached at 172 to the output conduit 174. An embracing coupling socket 175, receives the part-spherical coupling 171 in fluid tight relationship. The sealing rings 177, 178 being such as to frictionally and sealingly engage with the ball member 170. The arrangement permits two degrees of freedom of movement between ball 170 and socket 175. In the configuration shown, the ball 170 is fixed to the output conduit 174, and the socket 175 moves relatively to the ball 170, carrying the nozzle (not shown) with it. The nozzle inner end is depicted by the dotted line 180.

As will be seen, the socket 175 is made of two parts, an outer piece 181 which carries the sealing ring 177 and an inner piece 184 which threadedly engages with the outer piece 181 and carries the inner sealing ring 178. The inner member 184 is configured at 187 to receive the inner end of the nozzle.

Figure 12:
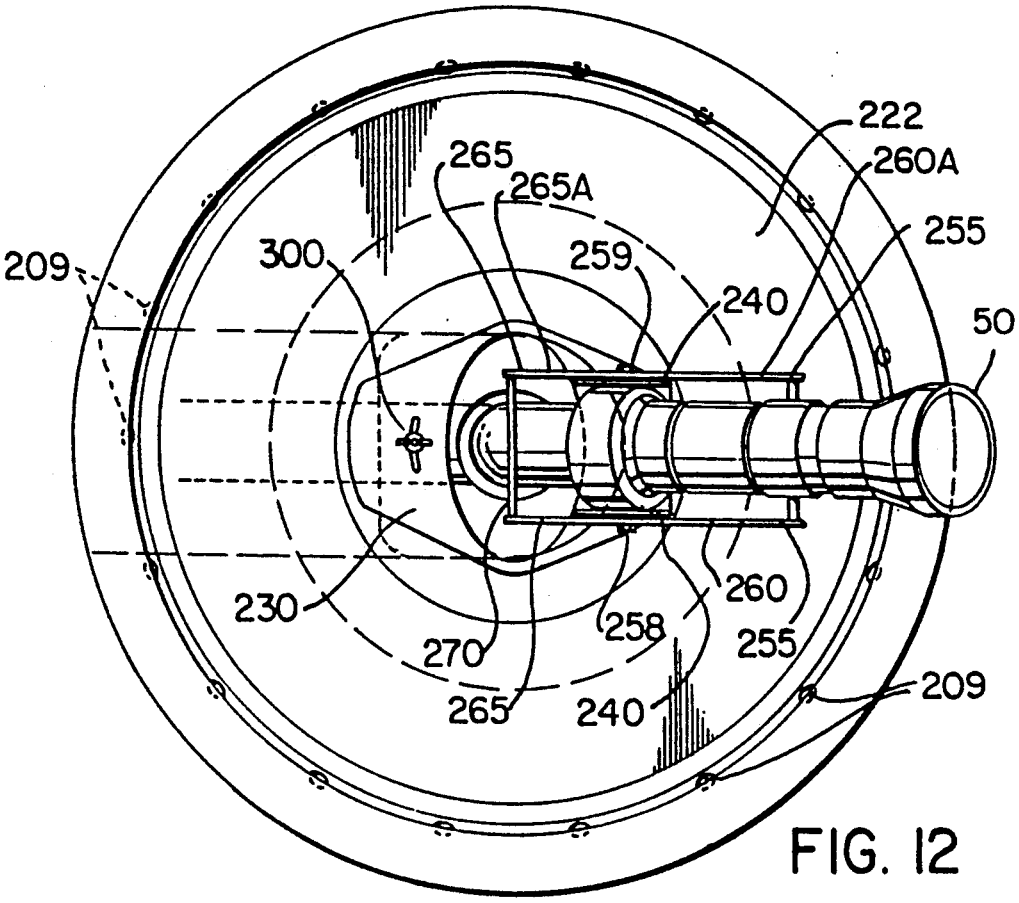
FIG. 12 is a plan view of the base of FIG. 11.
Figure 11:
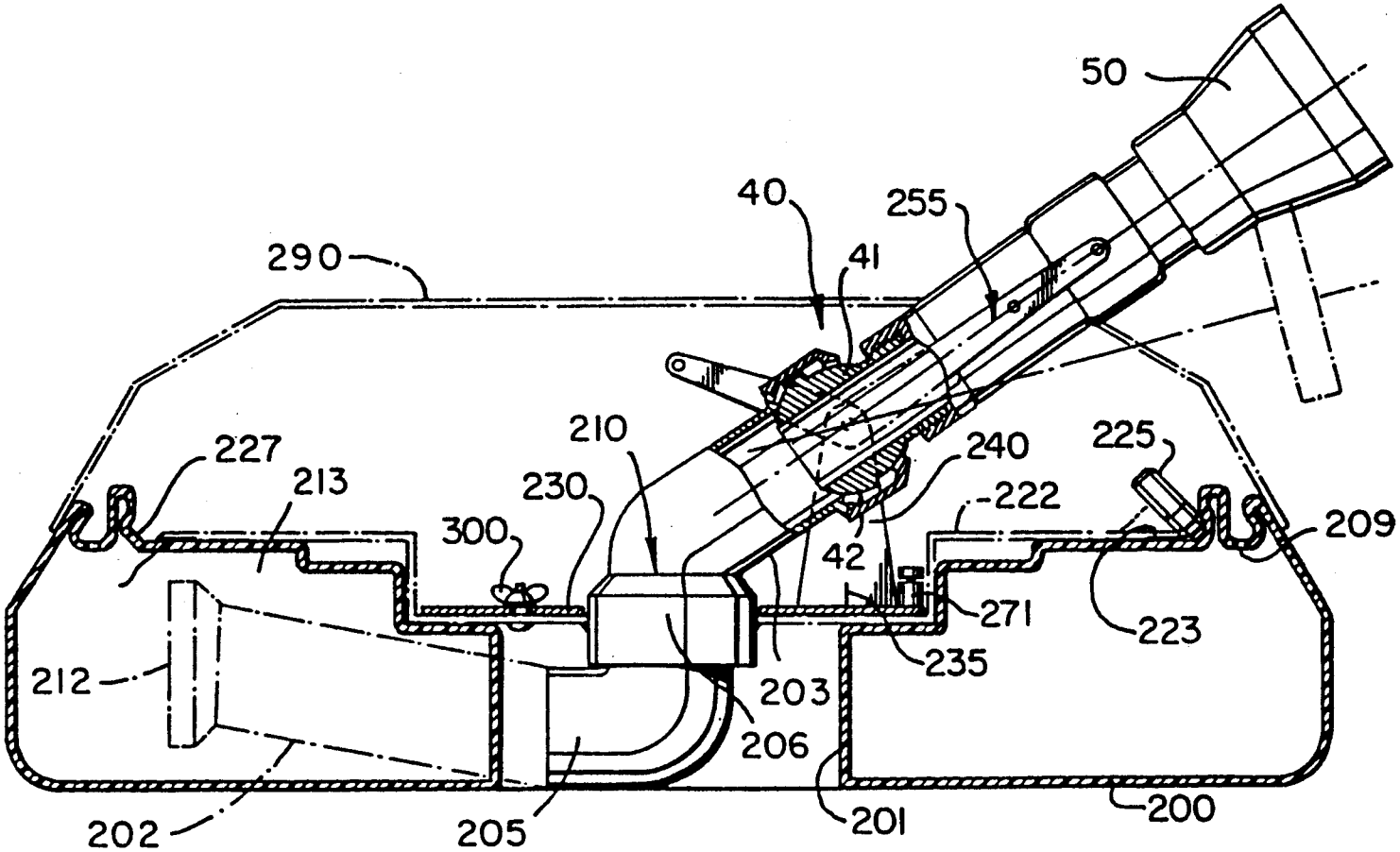
FIG. 11 is a sectional view of an alternative base configuration.

Turning now to FIGS. 11 and 12.

In FIG. 11, a base 200 is shown which is similar to the base shown in FIG. 8 in that it is made of a molded plastics one piece material but here in FIG. 11, the base is shown of hollow torroidal, or doughnut, configuration having a central throughway 201 to accept the input conduit 202 and the output conduit 203. The input conduit 202 (see FIG. 9) terminates in, and forms the lower coupling part 205 of the vertical axis swivel action coupling 210, whilst the output conduit 203 terminates in, and forms, the upper part 206. In the embodiment shown in FIGS. 9 and 11 the lower part 205 and upper part 206 of the swivel action coupling 210, are one piece molded with the input conduit 202 and the output conduit 203 respectively. The rear end of the input conduit 202 terminates in a hose coupling 212 and it is to be understood that the hollow body 213 of the base is provided with sidewalls, not shown, similar to the sidewalls 18 and 19 of FIG. 4 to permit the passage of the input conduit 202.

The upper part 206 of the coupling is operatively connected through the conduit 203 with the ball and socket coupling 40.

The torroidal shaped base is provided with a plurality of holes 209 (FIG. 12) around its upper periphery so that the base can be filled with water to give weight to the base. Any other suitable means may be provided to fill and empty the base.

A stepped revolving platform 222 (FIGS. 9 and 11) is fixedly connected to the upper member 206 of the vertical axis coupling and, as with the plate member 55 of the configuration of FIG. 1, can be rotated with the upper part 206 of the coupling and runs on a peripheral track 223 on guide wheels (not shown). A centering wheel 225 runs against the groove 227 on the upper part of the base 200. Mounted on and vertically spaced from the stepped platform 222 is a second platform 230 which is connected to the platform 222 by a vertical pivot pin 235, which pivot 235 is located substantially directly below the center point of the ball 41.

A pair of upstanding lugs 240 are fixed to the second platform 230 and extend upwardly on either side of the ball and socket joint 40. A connecting arm 255 is in two halves (see FIG. 12) and is connected by trunnions 258, 259 to the lugs 240. The arm 255 has forward sections 260, 260A which connect to the nozzle 50 in much the same fashion as in the embodiment of FIG. 1, and two bell crank ends 265, 265A which are connected by a cross member 270.

As in the earlier devices, the embodiment of FIGS. 11 and 12 can be either manually, or power, operated. For manual operation the nozzle selections will be of standard form.

For rotation through 360°, or part thereof, the handle 270, in manual operation, is grasped and the nozzle 50 is rotated about the vertical axis of the swivel action coupling on platform 220, platform 230 being carried with it. When it is desired to elevate or depress the nozzle the handle 270 is pushed or pulled to rotate the bell cranks 265, 265A about the trunnions 258, 259 to elevate and depress the nozzle by means of the lever parts 260, 260A and their trunnion connections to the nozzle. When it is desired to offset the ball and socket, a suitable wing nut 300 operating in a slot in the platform 222, or some other adjustable fixing means, can be operated to unlock the platform 230 from the platform 222, and whilst holding the platform 222 steady about the axis of the coupling 210, the second platform 230 can be rotated about its pivot point 235 relative to platform 222 to skew the ball 152 in its socket 150 to obtain the offset position for the ball 152.

It will be understood that the platform 230 could be, if desired, mounted beneath the stepped platform 222. In this case platform 222 would be provided with appropriate slots to allow passage of lugs 240 and to permit relative movement about pivot points 235 for skewing of the nozzle 50.

When operating under power, a motor such as the motor 48 of FIG. 1 can be provided to rotate the platform 222. An actuator driven connection can be provided between the arm 270 and the second platform 230 to tilt the nozzle so as to elevate or depress it. A gear motor such as 271 can be provided between the second platform 230 and the stepped platform 222 to rotate the platform 230 relative to the stepped platform 220 to skew the ball 152 in its socket 150.

A lid 290 may be provided to cover the base and to rotate on it with the platform 230. A wide slot is provided to pass the nozzle 50.

It will be seen that the device according to the present invention gives to the operator the ability of providing high gallonage of water in a variety of tactical situations to irrigate, or combat a fire. The device, for example, may be helicopter deployed to a suitable fire site where it can be set up with the nozzle in the offset position to continuously rotate and soak down an entire circular area of ground. Alternatively, it can be moved or the motors 60M and 61M can be driven alternately so as to wet down a 180° arc in the path of a fire, or indeed whatever sweep of arc is desired.

The device, being positioned on a sturdy stable base, which may be water filled, is not likely to move from its set position.

A fog or spray pattern can be selected for the nozzle and consequently a variety of types of wetting operation can be obtained. When connected to a suitable radio control device the whole operation of the monitor can, in its automatic configuration, be controlled from a helicopter or a safe position on the ground or, if hard wired, can be controlled by a remote operator and thus the invention provides the forest fire fighter with a unique tool giving him the versatility of adapting his tactics of fighting the fire to the conditions of the fire.

The embodiments of the invention in which an exclusive property or privilege is claimed are defined as follows:

1. A portable fire fighting monitor comprising:

a base member of low wide configuration being an essentially hollow structure of generally circular configuration having upper and lower surfaces joined by a peripheral wall, and means to permit filling and emptying of at least a major part of said hollow structure with fluid to impart stability to said base member;

fluid input conduit means in said base member;

a vertical axis swivel action coupling centrally mounted on said base, said coupling having a fixed lower part and an upper part that is rotatable about said axis, said coupling being operatively connected at its lower part to said fluid input conduit means and being operatively connected at its upper part to a fluid output conduits means;

a ball and socket coupling operatively connected to said fluid output conduit means;

a monitor nozzle operatively connected to an outer end of said ball and socket coupling;

means to elevate and depress said nozzle relative to said base member on said ball and socket coupling;

means to rotate said nozzle and said ball and socket coupling relative to said base member on said swivel action coupling about the vertical axis of said swivel action coupling, said means to rotate comprising a support member mounted for rotation about said vertical axis, above and parallel to said upper surface, and operatively connected to said swivel action coupling said base including a circumferential track adjacent an outer edge of said upper surface thereof and said plate including drive means in engagement with said track.

2. A device as claimed in claim 1 further including a manually operable control arm means attached to said nozzle and operable to rotate said nozzle and said ball and socket coupling, about said coupling vertical axis on the track.

3. A device as claimed in claim 1 wherein said means to rotate said nozzle and said ball and socket coupling relative to said base member further includes a motor mounted on said support member and drivingly connected to a friction drive means engaging said track.

4. A portable fire fighting monitor comprising:

a base member of low wide configuration, having a lower side for resting on the ground and an upper side spaced above said lower side, said base including an unpressurized chamber occupying the major part of the volume of said base, and means enabling filling of said chamber with water to stabilize said base;

fluid input conduit means in said base member;

a vertical axis swivel action coupling centrally mounted on said base member, said coupling being located adjacent the upper side of said base member, said swivel axis coupling having a lower part and an upper part;

said swivel axis coupling being operatively connected at its lower part to said fluid input conduit means and being operatively connected at its upper part to a fluid output conduit means;

a monitor nozzle operatively connected to an outer end of said fluid output conduit means, a ball and socket coupling operatively connected between said fluid output conduit means and said monitor nozzle;

means to elevate and depress said nozzle relative to said base member;

and drive means to rotate said nozzle relative to said base member about the vertical axis of said coupling, said drive means comprising a drive element carried on a support member mounted for rotation about said vertical axis above and parallel to an upper surface of the base, and operatively connected to said swivel action coupling, said drive element engaging a circumferential track on said base surface.

5. A portable fire fighting monitor as claimed in claim 4 further including a nozzle guide means mounted on said support member and embracing said nozzle, and a control arm means attached to said nozzle and operable to rotate said nozzle, said nozzle guide means and said support member, about said coupling vertical axis.

6. A portable fire fighting monitor as claimed in claim 5 including means to offset position said nozzle on said ball and socket coupling with respect to said vertical axis of said swivel action coupling, said means to offset position said nozzle comprising a vertically oriented pivotal connection between said support member and said nozzle guide means radially spaced from said vertical axis, and locking means to secure said nozzle guide means to said support member.

7. A portable fire fighting monitor comprising:

a base member of low wide configuration, having a lower side for resting on the ground and an upper side spaced above said lower side, said base including an unpressurized chamber occupying the major part of the volume of said base, and means enabling filling of said chamber with water to stabilize said base;

fluid input means in said base member;

a vertical axis swivel action coupling centrally mounted on said base member, said coupling being located adjacent the upper side of said base member, said swivel axis coupling having a lower part and an upper part;

said swivel axis coupling being operatively connected at its lower part to said fluid input conduit means and being operatively connected at its upper part to a fluid output conduit means;

a monitor nozzle operatively connected to an outer end of said fluid output conduit means;

means to elevate and depress said nozzle relative to said base member;

drive means to rotate said nozzle relative to said base member about the vertical axis of said coupling;

wherein the base is a round molded plastic body having upper and lower walls separated by an integral peripheral wall, the body defining a radial recess to accept said fluid input conduit and having an open central area in which is located at least the lower portion of said swivel action coupling.

8. A portable fire fighting monitor comprising a hollow base member of low wide configuration said base member having an interior that defines a large unpressurized water-fillable chamber that is substantially completely enclosed but is vented to atmosphere at its upper side; fluid input conduit means in said base member; a vertical axis swivel action coupling centrally mounted in said base, said coupling having a fixed lower part and an upper part that is rotatable about said axis, said coupling lower part being integral with said fluid input conduit means and said coupling upper part being integral with a fluid output conduits means and located in a central recess in said base; a ball and socket coupling operatively connected to said fluid output conduit means, a monitor nozzle operatively connected to an outer end of said ball and socket coupling; means to elevate and depress said nozzle relative to said base member about said ball and socket coupling; and means to rotate said nozzle and said ball and socket coupling relative to said base member on said swivel action coupling about the vertical axis of said swivel action coupling.

9. A portable fire fighting monitor comprising a hollow base member of low wide configuration said base member comprising a molded plastic substantially cylindrical body having upper and lower surfaces separated by an integral peripheral wall, the body being provided with at least one aperture to accept a water input conduit, said unpressurized chamber occupying a major portion of the interior of said body and being adapted to be filled with water; fluid input conduit means in said aperture; a vertical axis swivel action coupling centrally mounted in said base, said coupling having a fixed lower part and an upper part that is rotatable about said axis, being operatively connected at its lower part to said fluid input conduit means and being operatively connected at its upper part to a fluid output conduits means; a ball and socket coupling operatively connected to said fluid output conduit means; a monitor nozzle operatively connected to an outer end of said ball and socket coupling; means to elevate and depress said nozzle relative to said base member about said ball and socket coupling; and means to rotate said nozzle and said ball and socket coupling relative to said base member on said swivel action coupling about the vertical axis of said swivel action coupling; said means to rotate comprising a revolving platform attached to said coupling upper part for rotation therewith; a pair of lugs upstanding from said revolving platform one on either side of said ball and socket coupling; and connecting means connected to said lugs and to said nozzle.

10. A device as claimed in claim 9 in which said connecting means is manually operable to rotate said nozzle, said ball and socket coupling, and said revolving platform, about said coupling vertical axis.

11. A device as claimed in claim 9 in which motor means are provided to drive said revolving platform to rotate said nozzle, said ball and socket coupling, and said revolving platform about said coupling vertical axis.

12. A device as claimed in claim 9 in which said connecting means are formed as a lever pivotally connected to said lugs and operable as said means to elevate and depress said nozzle.

13. A portable fire fighting monitor as set forth in claim 9 including radio controlled means operative to govern at least some of: nozzle flow control, nozzle spray pattern control, nozzle elevation, and nozzle azimuth.

* * * * *